United States Patent [19]

Lorenzen

[11] 4,063,563

[45] Dec. 20, 1977

[54] METHOD AND APPARATUS FOR BUILDING A TOBACCO FILLER

[75] Inventor: Heinz-Christen Lorenzen, Hamburg, Germany

[73] Assignee: Hauni-Werke Körber & Co., KG, Hamburg, Germany

[21] Appl. No.: 729,694

[22] Filed: Oct. 5, 1976

[30] Foreign Application Priority Data

Oct. 10, 1975 Germany ..... 2545416

[51] Int. Cl.[2] ..... A24C 5/18

[52] U.S. Cl. ..... 131/21 D; 131/84 C

[58] Field of Search ..... 131/21 R, 21 A, 21 B, 131/21 D, 84, 84 C, 84 B, 21 C

[56] References Cited

U.S. PATENT DOCUMENTS

| | | | |
|---|---|---|---|
| 3,132,650 | 5/1964 | Richter | 131/21 D |
| 3,431,914 | 3/1969 | Richier | 131/84 C X |
| 3,504,679 | 4/1970 | Lowman | 131/84 C |
| 3,750,675 | 8/1973 | Klemme | 131/84 C X |
| 3,954,112 | 5/1976 | Brackmann et al. | 131/84 C X |
| 3,996,948 | 12/1976 | Baier | 131/21 R |

*Primary Examiner*—Stephen C. Pellegrino
*Attorney, Agent, or Firm*—Peter K. Kontler

[57] ABSTRACT

A continuous tobacco filler is formed by feeding tobacco shreds at a variable rate into a first portion of an elongated path wherein the shreds are transported by a conveyor to form a growing stream which is fully grown as soon as its particles leave the first portion of the path. The fully grown tobacco stream contains a surplus of tobacco, and such surplus is removed in a second portion of the path to convert the fully grown stream into a filler. The quantity of tobacco in the growing or fully grown stream and in the filler is measured by two detectors which furnish corresponding signals to a dividing circuit. The latter transmits a further signal which is a quotient of the received signals and is used to regulate the rate of feed of tobacco shreds into the first portion of the path.

10 Claims, 2 Drawing Figures

2a
32a
32b
2b
33a
4a
2
33b
3
29
31
2b
32b
4b
32a
2a
2
33a
3
29
31
34
8
9
34
35
36
36
37
37
35
38
38
39
41
42
43
46
48
44
47
49
52
51
53

METHOD AND APPARATUS FOR BUILDING A TOBACCO FILLER

BACKGROUND OF THE INVENTION

The present invention relates to a method and apparatus for building a tobacco filler. More particularly, the invention relates to improvements in a method and apparatus for converting a continuous tobacco stream into a continuous rod-like filler by removing surplus tobacco from the stream.

In a cigarette making machine, a distributor feeds tobacco particles at a rate which is necessary to build a continuous tobacco stream containing a surplus of tobacco, i.e., tobacco in excess of that which is required in the filler of a cigarette rod. This is desirable because the cross-sectional area of the stream varies at an unpredictable rate, i.e., a filler (which is a continuous rod normally containing identical quantities of tobacco in each increment thereof, except when the filler is to be used for the production of dense-end cigarettes) of uniform density can be obtained only if the stream contains a surplus so that the minimum cross-sectional area of each and every portion of the stream is not less than the desired cross-sectional area of the filler.

As a rule, a selected adjustment of the distributor need not be changed if the characteristics of tobacco which is to be converted into a stream and thereupon into a rod-like filler do not change at all or fluctuate within a rather narrow range. For example, if the distributor receives one and the same blend of tobacco whose moisture content is constant, wherein the percentage of ribs, stem and other heavier particles (such particles are normally segregated from the particles which are to form the stream) is constant, and wherein each batch of tobacco particles contains the same or nearly the same amount of so-called shorts and tobacco dust, a selected adjustment of the motor for the distributor need not be changed for extended periods of time, e.g., during an entire shift. However, if the characteristics of tobacco vary considerably from batch to batch or from charge to charge, the selected adjustment might not be satisfactory because the distributor is likely to feed less tobacco than necessary for the making of a satisfactory filler or the stream will contain excessive amounts of surplus tobacco. The latter situation is equally undesirable because the equalizing device or devices invariably produce substantial amounts of so-called short tobacco and tobacco dust as well as because the moisture content of removed surplus tobacco is likely to change during transport back into the magazine of the distributor. Furthermore, the transport of removed surplus tobacco into the magazine of the distributor invariably entails additional comminution of tobacco. Therefore, it is necessary to monitor the quantity of tobacco in successive increments of the filler and to adjust the motor for the moving parts of the distributor when the monitoring step indicates that the tobacco stream should contain larger or smaller quantities of surplus.

Heretofore known apparatus which are used for adjustment of the distributor are not reliable and their reaction to changes in the mass of tobacco in successive increments of the filler is too slow. This is attributable to the nature of detectors which are used for the monitoring operation and also to the fact that presently known monitoring devices cannot transmit signals which are reliable indicators of the monitored mass of tobacco, mainly because the conventional monitoring devices cannot take into consideration unpredictable changes of certain physical and/or chemical characteristics of tobacco particles, especially the moisture content.

SUMMARY OF THE INVENTION

An object of the invention is to provide a novel and improved method of regulating the feed of tobacco particles which are to form a continuous stream ready for conversion into the filler of a wrapped tobacco rod which is to be subdivided into plain cigarettes, cigarillos or cigars.

Another object of the invention is to provide a method of the just outlined character which can be resorted to in the making of a uniform tobacco filler wherein each and every increment contains identical quantities of tobacco.

A further object of the invention is to provide a method which insures that eventual deviations of the rate of tobacco feed by a distributor or the like from an optimum or desired rate are eliminated with negligible delay so that the length of unsatisfactory filler portions is only a fraction of the length of such portions in a filler which is produced in accordance with heretofore known methods.

An additional object of the invention is to provide a method of producing a continuous tobacco filler which is not influenced by moisture content and/or other unpredictable and hard-to-determine chemical and/or physical characteristics of processed material.

Another object of the invention is to provide a novel and improved apparatus for the practice of the above outlined method.

An ancillary object of the invention is to provide the apparatus with novel and improved means for monitoring the mass of a moving body of tobacco particles.

A further object of the invention is to provide novel and improved means for evaluating and processing signals which are transmitted by the aforementioned monitoring means.

One feature of the invention resides in the provision of a method of building a tobacco filler, particularly a filler which can be draped into a web of cigarette paper or the like to constitute therewith a continuous cigarette rod which is ready to be subdivided into plain cigarettes of desired length. The method comprises the steps of feeding particles of tobacco (e.g., shreds of tobacco leaf laminae) into a first portion of an elongated path, transporting the particles along the path whereby the particles which enter the first portion of the path automatically form a growing tobacco stream and the resulting fully grown tobacco stream (the stream is fully grown immediately downstream of the first portion of the path) advances beyond the first portion of the path, removing surplus tobacco from the fully grown stream in a second portion of the path to thus convert the fully grown stream into a filler (the second portion of the path may but need not be immediately adjacent to the first portion), monitoring the quantity of tobacco in successive increments of the growing or fully grown stream, monitoring the quantity of tobacco in successive increments of the filler, producing first and second signals which are respectively indicative of the monitored quantities of tobacco in the growing or fully grown stream and in the filler, producing third signals which are indicative of the quotient of the first and second signals, and utilizing the third signals for regulation of tobacco feed into the first portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
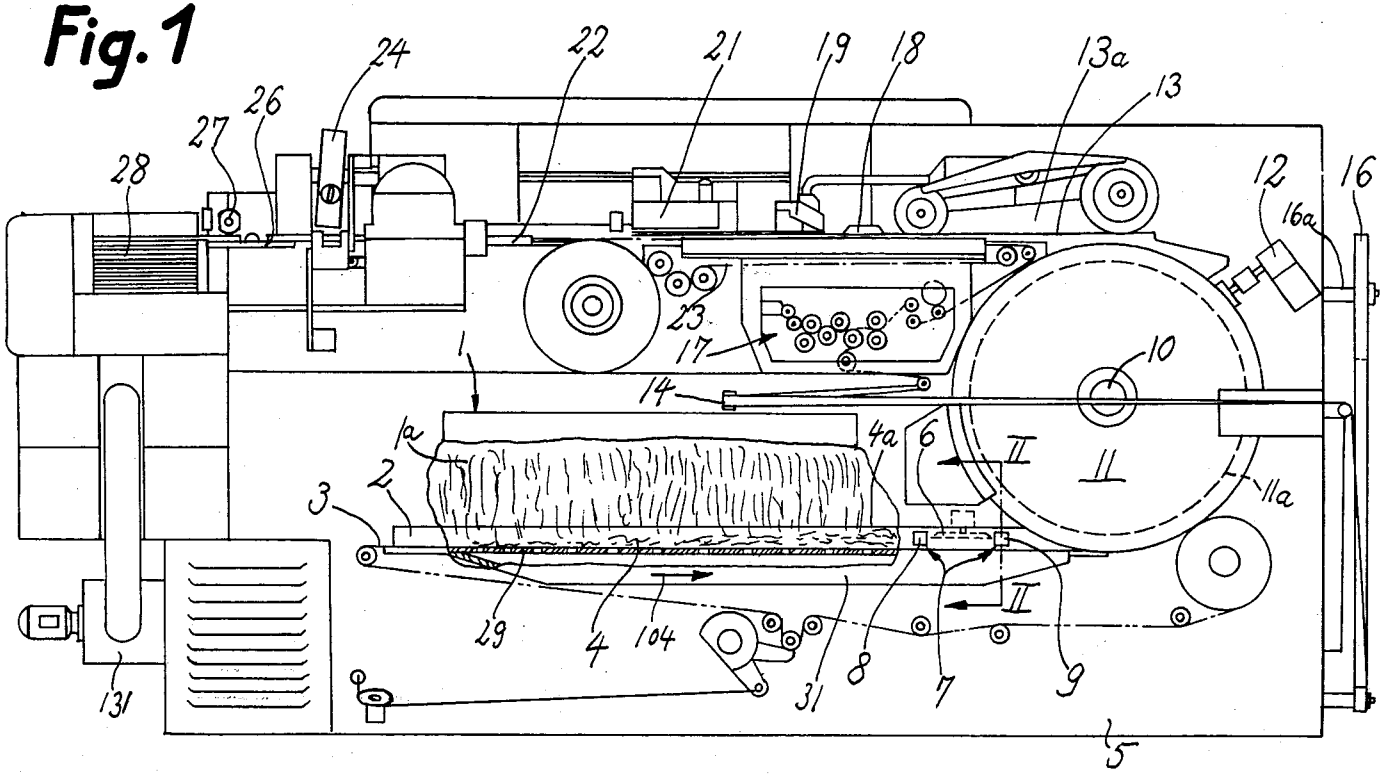
FIG. 1 is a schematic elevational view of a cigarette rod making machine including an apparatus which embodies the invention.

Referring first to FIG. 1, there is shown a cigarette rod making machine of the type known as GARANT (trademark) manufactured by Hauni-Werke Körber & Co. KG, of Hamburg-Bergedorf, Federal Republic Germany. The machine comprises a frame or housing 5 which supports a distributor 1 constituting a source of supply of tobacco particles and having a relatively wide band conveyor (not specifically shown) the leading edge of which supplies a wide shower 1*a* of tobacco particles (primarily shreds of tobacco leaf laminae) into an elongated narrow tobacco stream forming channel 2. The distributor 1 may be of the type disclosed in the commonly owned copending application Ser. No. 536,302 filed Dec. 24, 1974 by Alfred Hinzmann. The aforementioned band conveyor has a tobacco-supporting upper stretch which is substantially normal to the plane of FIG. 1 and advances tobacco particles in a direction toward the observer of FIG. 1.

The channel 2 is located at the top of an elongated suction chamber 31 having a perforated top wall 29 which constitutes the bottom wall of the channel. The manner in which the suction chamber 31 is connected with a fan 131 or another suitable suction generating device is not shown in the drawing. The means for transporting the growing tobacco stream 4 lengthwise (see the arrow 104 in FIG. 1) comprises a relatively narrow foraminous belt conveyor 3 having a substantially horizontal upper reach which travels immediately above the perforated top wall 29 so that the growing tobacco stream 4 adheres to and travels with the upper reach of the conveyor 3 in the direction indicated by arrow 104. The growing stream 4 resembles a flat wedge whose height increases in the direction of forward movement of the upper reach of the conveyor 3.

The fully grown tobacco stream 4*a* which is transported by the right-hand portion of the upper reach of the conveyor 3 is caused to travel below a trimming or equalizing device 6. The adjustment of the distributor 1 is such that the fully grown tobacco stream 4*a* contains a surplus of tobacco, i.e., more tobacco than is necessary in the filler of a satisfactory cigarette rod. Such surplus is removed, in part, by the equalizing device 6 which is arranged to trim the exposed upper side of the fully grown stream 4*a*. The equalizing device 6 is flanked by the detectors 8 and 9 of a monitoring device 7 which is constructed and assembled in accordance with a feature of the invention and whose function is to determine the quantity of tobacco in successive increments of the fully grown tobacco stream 4*a* (see the detector 8) as well as the quantity of tobacco in successive increments of the once-equalized stream or filler 4*b* (see FIG. 2). The detectors 8 and 9 are capacitors, and their construction, as well as the construction of other parts of the monitoring device 7, is shown in detail in FIG. 2.

The upper reach of the conveyor 3 delivers successive increments of the once-trimmed tobacco stream or filler 4*b* into the circumferential groove 11*a* of a second tobacco transporting conveyor 11 here shown as a suction wheel mounted in the frame 5 on a shaft 10 and rotating in a counterclockwise direction, as viewed in FIG. 1. The bottom wall of the groove 11*a* is foraminous and such bottom wall surrounds a stationary suction chamber which extends between the six o'clock and twelve o'clock positions of the conveyor 11, as viewed in the direction of rotation of this conveyor. The purpose of the suction chamber in the conveyor 11 is to attract the filler 4*b* to the bottom wall of the groove 11*a* while the filler advances from the conveyor 3 to a further transporting conveyor 13. A second trimming or equalizing device 12 is adjacent to the circumferential groove 11*a* and serves to trim the adjacent side of the filler 4*b* so that the latter is converted into a substantially-rod like final filler which is ready to be wrapped into a web 14 of cigarette paper. It will be noted that the equalizing devices 6 and 12 remove surplus tobacco from opposite sides of the body of tobacco particles which advance along the path defined by the conveyors 3, 11 and 13.

The conveyor 13 removes the final filler from the circumferential groove 11*a* of the conveyor 11 and transfers it onto the upper reach of a further conveyor 23 known as garniture. The final filler is transferred by the lower reach of the endless flexible element of the conveyor 13, and such flexible element is foraminous so that the filler is attracted to the lower reach during travel below the perforated bottom wall of a stationary suction chamber 13*a*.

The web 14 of cigarette paper is withdrawn from an expiring reel 16 whose spindle 16*a* is mounted on the frame 5. Successive increments of the web 14 advance through an imprinting mechanism 17 which applies indicia to spaced-apart portions of the web. Such indicia may represent the name of the manufacturer, the brand name of the cigarettes, the trademark(s) of the manufacturer and/or others. The web 14 thereupon reaches the right-hand end of the upper reach of the garniture 23 and transports successive increments of the final filler through a wrapping mechanism 18 which drapes the web around the final filler so that one marginal portion of the web contacts the filler and the other marginal portion extends substantially tangentially of the filler and can receive a film of adhesive from a paster 19. The thus coated other marginal portion of the web 14 is thereupon folded over the one marginal portion to form therewith a seam which extends lengthwise of the resulting continuous cigarette rod 22. The seam advances past a suitable sealer 21 which may constitute a heating device or a cooling device, depending upon the nature of adhesive which is applied by the paster 19 (if the adhesive is a wet adhesive, the sealer heats the seam and the seam is cooled if the adhesive is a hotmelt).

The rod 22 advances through a severing device 24 of the type known as cutoff which subdivides the rod into a file of aligned plain cigarettes 26 of unit length or multiple unit length. Successive cigarettes 26 of the single file are accelerated by a rapidly rotating cam 27 which propels them into successive peripheral flutes of a drum-shaped row forming conveyor 28. The latter converts the single file of cigarettes into one or more rows wherein the cigarettes move sideways and are delivered to storage, to a tray filing device, to a packing machine, or to a filter cigarette making machine, not shown.

It will be noted that the quantity of tobacco in successive increments of the final filler remains unchanged all the way between the locus of second trimming (equalizing device 12) and the locus where the final filler is draped into the web 14.

Figure 2:
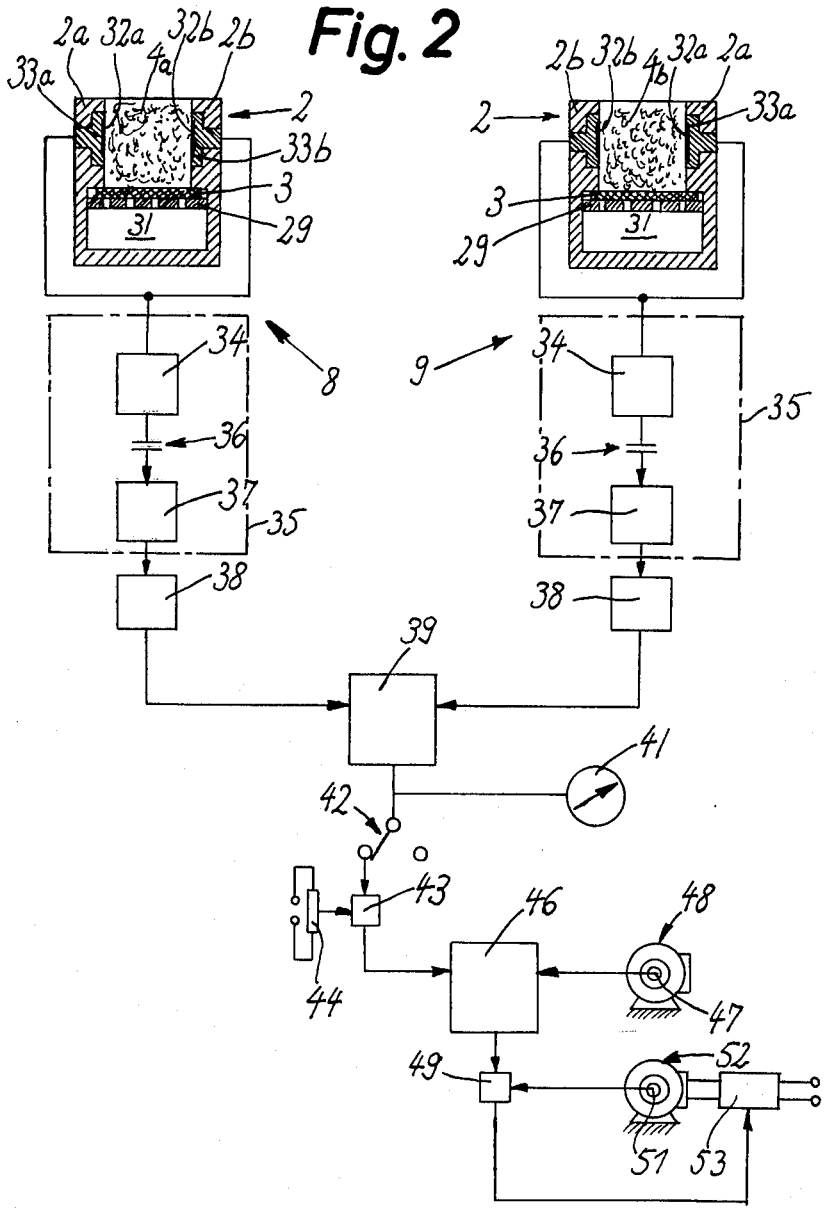
FIG. 2 is a block diagram of the monitoring means and of means for regulating the tobacco feed, portions of FIG. 2 constituting sections one of which is taken along the line II—II of FIG. 1.

Referring to FIG. 2, the construction of the detector 8 is identical with that of the detector 9. The only difference is in the location of these detectors, i.e., the detector 8 is located upstream and the detector 9 is located downstream of the first trimming device 6. The detector 8 comprises two electrodes or plates 32*a*, 32*b* which are respectively mounted in the side walls 2*a* and 2*b* of the tobacco channel 2. These side walls constitute two counterelectrodes and are electrically separated from the respective electrodes 32*a*, 32*b* by insulators 33*a*, 33*b* which are recessed into the channel 2. The fully grown tobacco stream 4*a* travels in the space between the electrodes 32*a* and 32*b*. An advantage of the detector 8 is that it can immediately respond to any and all changes in the quantity of tobacco in successive unit lengths of the fully grown stream 4*a* and that the intensity of signals furnished by the detector 8 is a highly reliable indicator of the monitored mass of tobacco.

The electrodes 32*a*, 32*b* of the detector 8 are connected with a high-frequency oscillator circuit 34 of the monitoring device 7. The detector 8 constitutes the frequency-determining capacitor of the oscillator circuit 34 which is connected with a high-frequency reference oscillator circuit 37 through the medium of a capacitor 36. The frequency of the oscillator circuit 37 is constant. The circuits 34 and 37 are constructed and mounted in such a way that their behavior in response to changes in temperature is identical. To this end, the circuits 34 and 37 can be installed on a common support and/or in a common compartment 35 (indicated by phantom lines). The compartment 35 is preferably air conditioned so that the temperature in its interior is at least substantially constant.

The frequency of the oscillator circuit 34 is a function of the mass of successive increments of the fully grown stream 4*a* which travels lengthwise between the electrodes 32*a*, 32*b* of the detector 8. Such frequency is superimposed upon the constant frequency of the reference oscillator 37 so that the output of the circuit 37 transmits a high-voltage signal whose frequency (beat frequency) is a resultant of the two superimposed frequencies. The amplitude of the high-voltage signal at the output of the oscillator circuit 37 varies periodically at a certain frequency between a minimum and a maximum amplitude. The frequency of the signal at the output of the oscillator circuit 37 is relatively low (it corresponds to the difference between the frequencies of the circuits 34 and 37) so that variations of such frequency can be determined in a relatively simple way and with a high degree of accuracy. The high-voltage low-frequency signal which appears at the output of the oscillator circuit 37 is transmitted to the input of a metering device 38 which is a proportional amplifier and whose output transmits a signal having an intensity which is proportional to the frequency of signal at the output of the oscillator circuit 37. Thus, the intensity of signal at the output of the amplifier 38 varies as a function of changes in the mass of tobacco in successive increments of the fully grown stream 4*a*.

The high-frequency oscillator circuits 34, 37 and the amplifier 38 may be of the type disclosed in the commonly owned German Offenlegungsschrift No. 2,590,299.

The detector 9 determines the mass of tobacco in successive increments of the once-trimmed filler 4*b*. Its components are identical with those of the detector 8. The same applies for the right-hand oscillator circuits 34, 37, capacitor 36, compartment 35 and amplifier 38 of FIG. 2; these parts are identical with the similarly numbered parts in the left-hand portion of FIG. 2.

The signal which appears at the output of the right-hand amplifier 38 of FIG. 2 is indicative of the mass of tobacco particles in successive increments of the filler 4*b*. The signals which are transmitted by the two amplifiers 38 are applied to the corresponding inputs of a signal dividing circuit 39. This circuit may be of the type known as AD 530 produced by Analog Devices. The intensity of the signal which appears at the output of the circuit 39 constitutes the quotient of the intensities of signals transmitted by the amplifiers 38, and such quotient signal is transmitted to one input of a subtracting circuit 43 by way of a switch 42. The other input of the circuit 43 receives a reference signal from a preferably adjustable potentiometer 44.

An important advantage of the circuit 39 is that the signal which is transmitted by its output is not affected by an unpredictable parameter of tobacco which forms the stream 4*a* and filler 4*b*, namely, by the moisture content of tobacco. In other words, the signal which is transmitted by the output of the circuit 39 is indicative solely of the mass of tobacco in the fully grown stream 4*a* or of the mass of tobacco in the surplus which is removed by the equalizing device 6. The intensity of the signal which is transmitted by the output of the circuit 39 can be observed by looking at the scale of a suitably calibrated measuring instrument 41.

The circuit 43 transmits a signal which is indicative of the difference between the desired surplus (reference signal from the potentiometer 44) and the actual surplus (signal from the circuit 39) of tobacco which is removed by the equalizing device 6. The signal which appears at the output of the subtracting circuit 43 is transmitted to one input of a multiplying circuit 46 (e.g., a circuit of the type known as AD 530 produced by Analog Devices). The other input of the circuit 46 receives a signal from a tachometer generator 47 which monitors the speed of the output shaft of the prime mover 48 (e.g., a variable-speed electric motor) of the cigarette making machine. The signals which are transmitted to the circuit 46 are voltage signals, and the output of the circuit 46 transmits a signal whose intensity matches the product of signals from 43 and 47; such signal is indicative of the desired or necessary surplus of tobacco in the stream 4*a* for the momentary operating speed of the cigarette making machine. The output of the circuit 46 transmits the signal to the corresponding input of a signal comparing circuit 49 which further receives a signal from a tachometer generator 51 driven by the output shaft of a variable-speed motor 52 which determines the rate of tobacco feed to the aforementioned band conveyor of the distributor 1, i.e., the quantity of tobacco in successive increments of the shower 1*a* is shown in FIG. 1. The output of the circuit 49 transmits signals to an amplifier 53 which regulates the speed of the motor 52 and hence the quantity of tobacco which is showered into the channel 2 per unit of time. The intensity of signal which is transmitted by the output of the circuit 49 equals the difference between the intensities of signals transmitted by the circuit 46 and tachometer generator 51. The signal at the output of the circuit 49 may be a positive or a negative signal, depending upon whether the potentiometer 53 is to increase or reduce the speed of the motor 52.

The purpose of the switch 42 is to interrupt the connection between the circuits 39 and 43 during starting of the cigarette rod making machine, i.e., when the channel 2 is still empty. The switch 42 may be closed or opened by hand or by a suitable detector (e.g., the detector 8) which monitors the path defined by the conveyors 3, 11 and 13 and transmits a signal to close the switch 42 when the monitored portion of the path contains tobacco.

It is further within the purview of the invention to place the detector 8 into the first portion of the path for tobacco particles, i.e., into the region below the distributor 1. Such mounting of the detector 8 might be desirable or necessary if the equalizing device 6 is immediately adjacent to the downstream end of the growing tobacco stream 4 in the first portion of the path defined by the conveyors 3, 11 and 13, i.e., if there is no room for the detector 8 between the equalizing device 6 and the tobacco stream growing zone. For example, and since the tobacco stream 4 normally grows at a constant rate, the detector 8 could be placed midway between the ends of the growing tobacco stream, namely, in the region where the quantity of tobacco per unit length of the growing stream equals or closely approximates 50 percent of the quantity of tobacco particles in the fully grown stream 4*a*.

An important advantage of the improved method and apparatus is that the signals (furnished by the output of the dividing circuit 39) which are used for regulation of the rate of tobacco feed by the distributor 1 are not influenced by an unpredictable factor (moisture content). This insures that the rate of tobacco feed into the first portion of the path defined by the conveyors 3, 11 and 13 can be regulated with a much higher degree of predictability and reproducibility than in heretofore known apparatus wherein the intensity or another characteristic of signals used to regulate the rate of tobacco feed by the distributor is influenced by the moisture content of conveyed material. As mentioned above, the influence of moisture content upon the signals which are used to regulate the speed of the motor 52 is eliminated by the dividing circuit 39.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A method of building a tobacco filler, comprising the steps of feeding particles of tobacco into a first portion of an elongated path; transporting the particles along said path whereby the particles which enter said first portion of said path form a growing tobacco stream and the resulting fully grown tobacco stream advances beyond said first portion of said path; removing tobacco from said fully grown stream in a second portion of said path to thereby convert said fully grown stream into said filler; monitoring the quantity of tobacco in successive increments of said stream; monitoring the quantity of tobacco in said filler; producing first and second signals which are respectively indicative of the monitored quantities of tobacco in said stream and said filler; producing third signals which are indicative of the quotient of said first and second signals; and utilizing said third signals for regulation of tobacco feed into said first portion of said path.

2. A method as defined in claim 1, wherein said signals are electric signals.

3. A method as defined in claim 2, wherein said first mentioned monitoring step comprises transporting successive increments of said stream between the plates of a first capacitor and the other of said monitoring steps comprises transporting successive increments of said filler between the plates of a second capacitor.

4. A method as defined in claim 1, wherein said first mentioned monitoring step includes monitoring the quantity of tobacco in said fully grown stream.

5. Apparatus for building a tobacco filler, comprising conveyor means defining an elongated path for tobacco particles; adjustable distributor means including means for feeding tobacco particles into a first portion of said path wherein the particles form a growing stream which is fully grown downstream of said first portion; means for removing tobacco from the fully grown stream in a second portion of said path to thereby convert said fully grown stream into said filler; monitoring means including first detector means adjacent to said path upstream of said second portion thereof and arranged to produce first signals indicative of the quantity of tobacco in successive increments of said stream, second detector means adjacent to said path downstream of said second portion thereof and arranged to produce second signals indicative of the quantity of tobacco in successive increments of said filler, and means for producing third signals at least one characteristic of which varies as a function of variations of the quotient of said first and second signals; and means for adjusting said distributor means in dependency on variations of said characteristic of said third signals.

6. Apparatus as defined in claim 5, wherein at least one of said detectors comprises a capacitor.

7. Apparatus as defined in claim 5, wherein said adjusting means comprises a variable-speed motor.

8. Apparatus as defined in claim 5, wherein said path is substantially horizontal and said removing means is located at a level above said conveyor means.

9. Apparatus as defined in claim 5, wherein said means for producing said third signals comprises a dividing circuit.

10. Apparatus as defined in claim 5, wherein said first detector means is disposed between said first and second portions of said path.

* * * * *